US005734955A

United States Patent [19]

Gruber et al.

[11] Patent Number: 5,734,955

[45] Date of Patent: Mar. 31, 1998

[54] DEVELOPMENT SYSTEM

[75] Inventors: Robert J. Gruber, Pittsford; Dan A. Hays, Fairport, both of N.Y.

[73] Assignee: Xerox Corporation, Stamford, Conn.

[21] Appl. No.: 716,076

[22] Filed: Sep. 16, 1996

Related U.S. Application Data

[60] Provisional application No. 60/010,168, Jan. 11, 1996.

[51] Int. Cl.[6] ..... G03G 15/08

[52] U.S. Cl. ..... 399/266; 399/292

[58] Field of Search ..... 399/225, 230, 399/231, 232, 261, 265, 266, 279, 290, 291, 292, 293; 118/647–649, 650–656, 658, 661; 430/110, 120; 361/226

[56] References Cited

U.S. PATENT DOCUMENTS

| | | | |
|---|---|---|---|
| 4,777,106 | 10/1988 | Fotland et al. | 430/120 |
| 5,132,735 | 7/1992 | Howland | 399/266 |
| 5,172,170 | 12/1992 | Hays et al. | 399/266 |
| 5,270,782 | 12/1993 | Floyd, Jr. | 399/266 |
| 5,630,200 | 5/1997 | Christy | 399/228 |

FOREIGN PATENT DOCUMENTS

| | | |
|---|---|---|
| 0 494 454 A2 | 7/1992 | European Pat. Off. . |
| 0 620 507 A1 | 10/1994 | European Pat. Off. . |
| WO 96/39647 | 12/1996 | WIPO . |

*Primary Examiner*—D. Rutledge
*Attorney, Agent, or Firm*—Lloyd F. Bean, II

[57] ABSTRACT

An apparatus for developing a latent image recorded on a surface, including a housing defining a chamber storing a supply of toner. A toner donor member is spaced from the image bearing surface and adapted to transport toner to a region opposed from the surface. A charging device is disposed in the chamber for ion charging the toner. An air injection system fluidizes the toner in the chamber. The injection system and a transport member cooperate with one another to define a region wherein a substantially constant quantity of toner having a substantially constant ion charge is deposited on the transport member. The toner is electrostatically transferred from the transport member to the donor member which contains interdigitated electrodes positioned near the surface of a dielectric core roll. An AC voltage is applied between the interdigitated electrodes to detach toner from the donor member so as to form a toner cloud for developing the latent image in an image on image process.

3 Claims, 3 Drawing Sheets

DEVELOPMENT SYSTEM

Priority is claimed from Provisional Application entitled "DEVELOPMENT SYSTEM" filed on Jan. 11, 1996 Ser. No. 60/010,168, now abandoned.

BACKGROUND OF THE INVENTION

This invention relates generally to a development apparatus for ionographic or electrophotographic imaging and printing apparatuses and machines, and more particularly is directed to a process of loading the surface of an interdigitated electroded donor roll with charged toner particles using a gaseous ion toner charging device. An AC voltage is applied to closely spaced interdigitated electrodes to form a toner cloud in the development zone for the development of a latent electrostatic image.

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

Moreover, the viability of printing system concepts such as image on image processing usually requires development systems that do not scavenge or interact with a previously toned image. Since several known development systems, such as conventional magnetic brush development and jumping single component development, interact with the image receiver, a previously toned image will be scavenged by subsequent development, and as these development systems are highly interactive with the image bearing member, there is a need for scavengeless or noninteractive development systems.

For scavengeless development systems, a donor roll can be used for transporting charged toner to the development nip defined by the space between the donor roll and photoconductive member. The donor roll can be loaded with toner from either a two component or single component development system. Toner is developed on the latent image recorded on the photoconductive member by a combination of mechanical and/or electrical forces to form a toner cloud in close proximity to the latent electrostatic image. Scavengeless development and jumping development are two types of single component development systems that can be selected. In one version of a scavengeless development system, a plurality of electrode wires are closely spaced from the toned donor roll in the development zone. An AC voltage is applied to the wires to generate a toner cloud in the development zone. The electrostatic fields associated with the latent image attract toner from the toner cloud to develop the latent image. In another version of scavengeless development, interdigitated electrodes are provided within the surface of a donor roll. The application of an AC bias between the adjacent electrodes in the development zone causes the generation of a toner cloud. In another version of a scavengeless development system with a single component loaded donor roll, the toned donor roll is brought into sufficiently close proximity to the electrostatic image such that the DC electric field causes the toner to jump across the gap to the photoreceptor so that the electrostatic fields associated with the latent image attract the toner to develop the latent image. Single component development systems appear to offer advantages in low cost and design simplicity. However, the achievement of high reliability for such systems continues to present problems.

SUMMARY OF THE INVENTION

Briefly, the present invention obviates the problems noted above by utilizing an apparatus for developing image on image processing, in which toner powder images of different color toners are superimposed onto the photoreceptor prior to the transfer of the composite toner powder image onto the substrate.

There is provided an apparatus for developing a latent image recorded on a surface, including a housing defining a chamber storing a supply of toner. A toner donor member is spaced from the surface and adapted to transport toner to a region opposed from the surface. With a DC voltage only applied between the donor member and photoreceptor, the development of fine lines and halftones is inadequate since the short range nature of such electrostatic image structures exerts a weak force on the toner layer on the donor. To provide improved development, a toner cloud is generated in the development zone by applying an AC voltage between closely spaced interdigitated electrodes on the donor member. The interdigitated electrodes are oriented in the axial direction near the surface of the dielectric donor roll. By generating a toner cloud with AC applied to interdigitated electrodes, the toner is brought close to the fine lines and halftones and yet is sufficiently spaced to prevent disruption or contamination of previously developed images. Toner is electrostatically transferred to the donor roll from a transport roll. The transport roll is continuously loaded with ion charged toner from a fluidized bed of toner in which a high voltage applied to a set of wires is positioned near the transport roll. The gaseous ions generated by the high voltage on the wires collect on the toner. The charged toner is attracted to the transport roll by electrostatic forces. The charging device is disposed in the chamber for ion charging the toner. An air injection system fluidizes the toner in the chamber. The injection system and the donor member cooperate with one another to define a region wherein a substantially constant quantity of toner having a substantially constant ion charge is deposited on the transport member.

The development system of the present invention enables greater simplicity and latitudes in developing high quality, full color images with an image on image process. Furthermore, the present invention enables high speed development with a single donor roll which makes possible a smaller development with a single donor roll which makes possible a smaller development housing when compared to two component development systems. To operate at higher speeds, a development system utilizing two component developer would need two donor rolls, (more complex design and cost), and the input power required to mix the two component developer would be high. The power required to charge the toner by mixing with carrier beads and to develop a sufficient quantity of charged toner particles in such a system would cause problems, e.g., excess heat build up in the developer housing.

Inasmuch as the art of electrophotographic printing is well known, the various processing stations employed in the printing machine illustrated in FIG. 1 will be shown hereinafter schematically and their operation described briefly with reference thereto.

Figure 1:
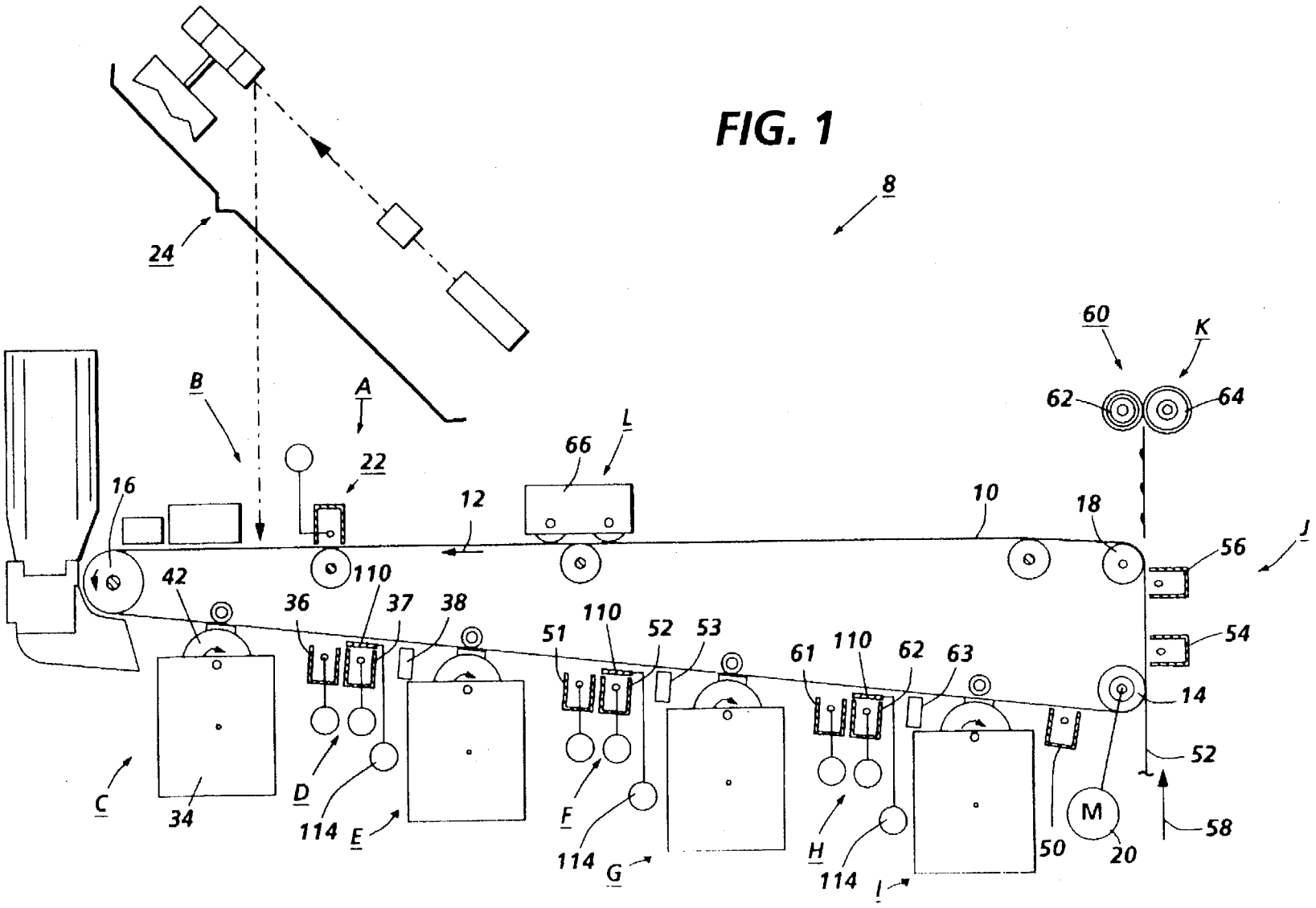
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
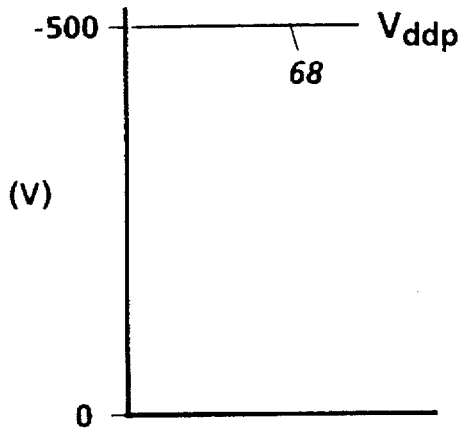
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
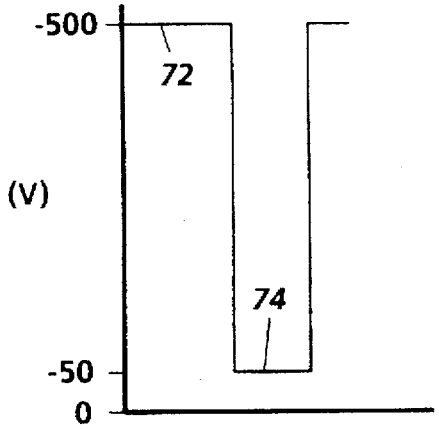
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

Figure 3:
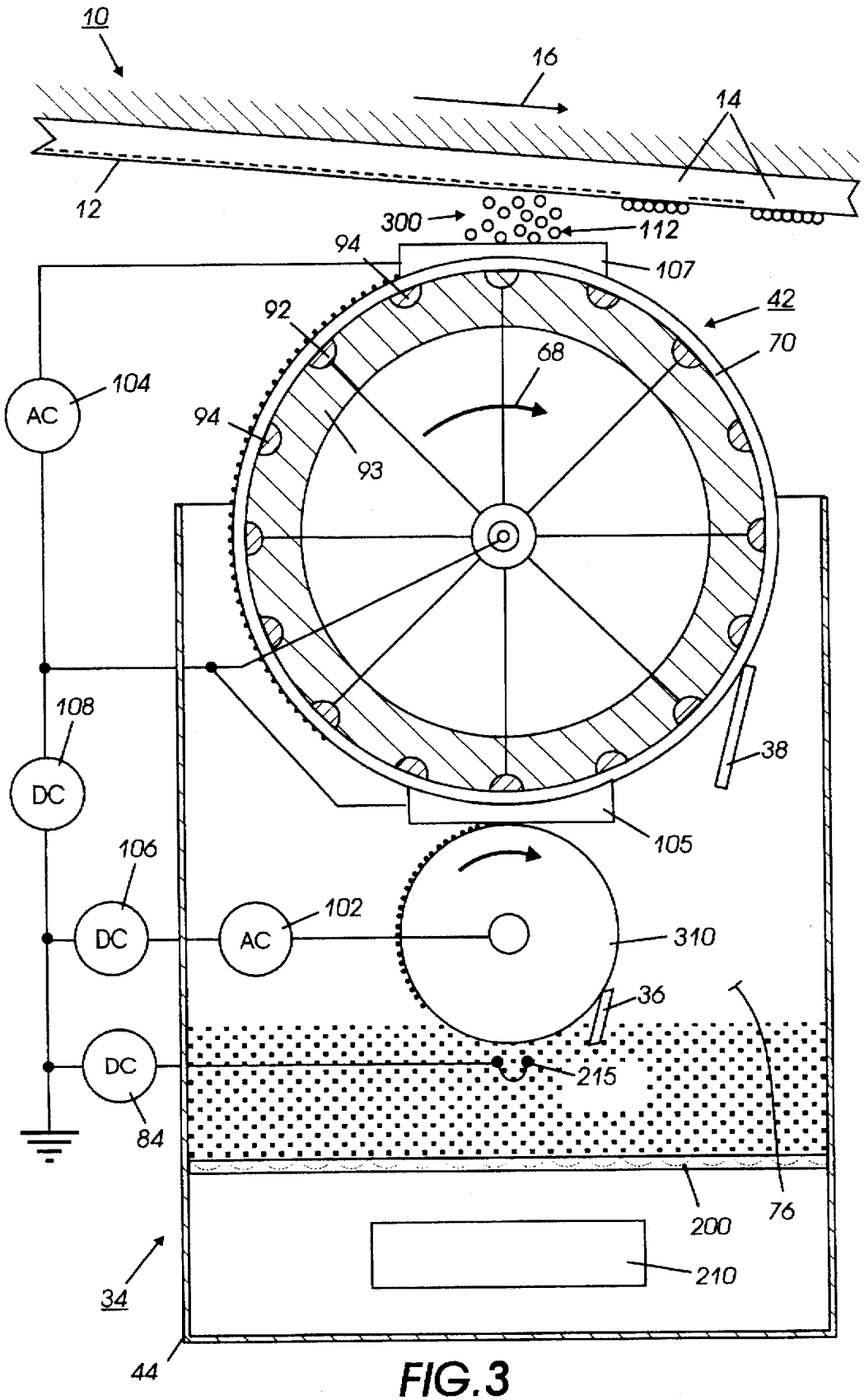
FIG. 3 is a schematic elevational view showing the development apparatus used in the FIG. 1 printing machine.

For the first development station C, development system 34 includes a donor roll 42, and interdigitated electrodes near the surface of the roll. As illustrated in FIG. 3, electrodes 94 are electrically biased with an AC voltage relative to adjacent interdigitated electrodes 92 for the purpose of detaching toner therefrom so as to form a toner powder cloud 112 in the gap between the donor roll and photoconductive surface. Both electrodes 92 and 94 are biased at a DC potential 108 for discharge area development (DAD). The discharged photoreceptor image attracts toner particles from the toner powder cloud to form a toner powder image thereon. Donor roll 42 is mounted in close proximity to a second transfer roll which is adjacent to a fluidized bed of toner. High voltage DC biased wires embedded in the fluidized bed near the transfer roll creates gaseous ions which are electrostatically attracted to the toner. An electrostatic force acting on the ion charged toner causes toner deposition onto the transfer roll. A DC or DC plus AC voltage is applied between the transfer roll and the donor roll to electrostatically transfer the desired polarity of toner, which discriminates against the opposite undesired toner charge.

Donor roll 42 is mounted, at least partially, in the chamber of developer housing 44. The chamber in developer housing 44 stores a supply of developer, (toner), material. The different development systems as represented by FIG. 3 comprise a housing containing a porous plate 200, an air injection system 210 and a charging unit 215. The air plenum system 210 injects air through the porous plate which causes fluidization of the toner in the housing. The charging unit 215 ionizes the air to charge the toner. The charging of the toner by ion deposition exerts an electrostatic force on the toner which causes the toner to deposit on the transfer roll 310. The charging unit 215 charges the toner particles relative to the biasing of transfer roll 310 so that the toner particles are attracted to the transfer roll 310. Transfer roll conveys the toner to donor roll 42. Donor roll 42 is biased with either a DC voltage or a DC voltage plus AC voltage relative to the biasing of transfer roll 310 so that the toner particles are attracted to the donor roll. Efficient means for fluidizing and charging toner is disclosed in U.S. Pat. No. 4,777,106 which is hereby incorporated by reference.

The developer material is preferably toner particles having a low cohesion and adhesion to the donor roll. It has been found that ion charging toners with low cohesion results in charges being substantially evenly distributed over the entire surface which results in reduced adhesion of toner to the donor roll, thereby improving development with a toner cloud. This also enables a desired uniform consistency of the developed mass of toner to be deposited onto the photoreceptor belt. Further, the reduced adhesion of the ion charged toner to the photoreceptor belt also improves transfer efficiency of the image to paper, and cleaning of the belt after transfer. The preferred toner is one manufactured using an in situ toner process as disclosed, "METHOD OF PREPARING A STABLE COLLOID OF SUBMICRON PARTICLES"; U.S. Ser. No. 08/214,518 (D/925791), filed Mar. 18, 1994, entitled "EMULSION POLYMERIZATION PROCESSES AND TONER COMPOSITIONS THEREFROM"; and U.S. Ser. No. 08/037,192 (D/92581), filed Mar. 23, 1993, entitled "SEMISUSPENSION POLYMERIZATION PROCESSES". Also, attention is directed to commonly assigned U.S. Pat. No. 5,278,020 issued Jan. 11, 1994, entitled "TONER COMPOSITION AND PROCESSES THEREOF"; and U.S. Pat. No. (not yet assigned), Ser. No. 07/976,604 (D/92579), filed Nov. 16, 1992, entitled, "POLYMERIZATION PROCESSES AND THEIR TONER COMPOSITIONS THEREFROM". The disclosure of the above mentioned patents and applications are incorporated herein by reference in their entirety. The in situ toner process produces a very narrow toner particle size distribution which improves image quality ((edge sharpness(lines and characters), cleaner backgrounds, broader color gamut, and more uniform image quality)). The narrow particle size distribution combined with ion charging produce a narrower toner charge distribution which also leads to improved image quality.

Figure 2C:
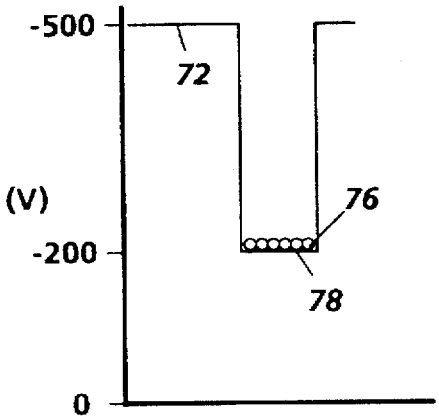
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

From FIG. 1, after passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
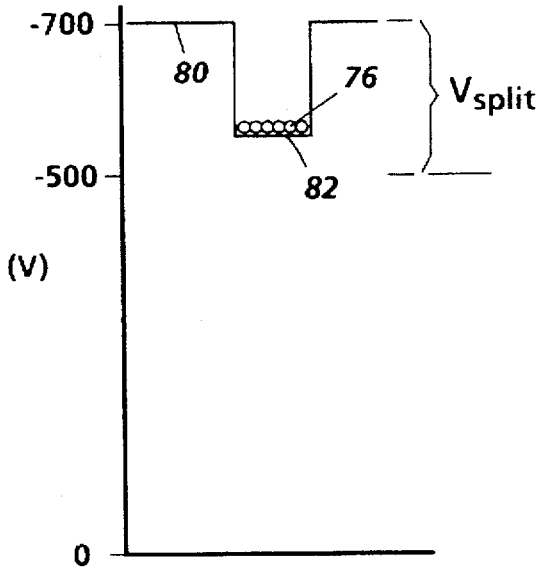
FIG. 2D shows a typical voltage profile of the image area after being recharged by a first recharging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area, reach a voltage level 80 of about −700 volts. The first recharging device 36 is preferably a DC scorotron.

Figure 2E:
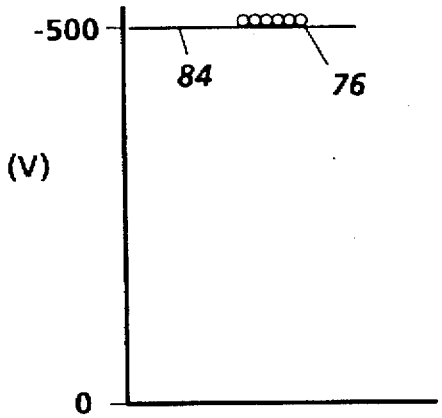
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
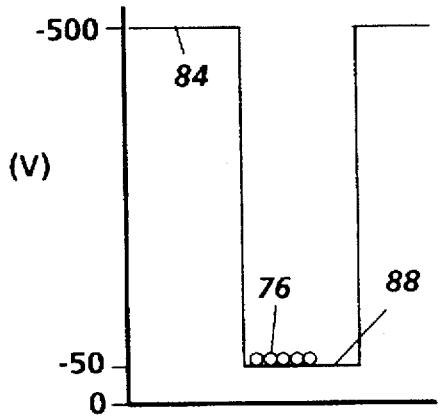
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E, as shown in FIG. 1. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 3 in greater detail, development system 34 includes a housing 44 defining a chamber 76 for storing a supply of developer material therein. Donor roll 42 comprises first and second sets of electrodes 92 and 94. The active interdigitated electrodes 94 and passive interdigitated electrodes 92 are near a transfer roll 310 of housing 44. The donor roll can be rotated in either the "with" or "against" direction relative to the direction of motion of the belt 10. Similarly, the transfer roll can be rotated in either the "with" or "against" direction relative to the direction of motion of the donor roll 42. In FIG. 3, donor roll 42 is shown rotating in the direction of arrow 68, that is the "with" direction. The core 93 of the donor roll is preferably comprised of a dielectric base, such as a polymeric material like a vinyl ester. The interdigitated electrodes near the surface of the donor roll are overcoated with a charge relaxable material 70. Doctor blades 36 and 38 are placed in contact with the rotating transport roll 310 and donor roll 42 to continuously remove toner from the rolls for return to the fluidized toner chamber 76.

An AC power source 104 applies an electrical bias of, for example, 1,200 volts peaks at 4 kHz between one set of electrodes 92 and the other set of electrodes 94. The electrodes 94 extend to one end of the donor roll to contact the commutator brush 107 which is attached to the AC voltage 104. The electrodes 92 are all connected together at the opposite end of the donor roll and attached to the DC supply 108, as well as the transfer roll-donor roll commutator brush 105. A DC bias from 0 to 1,000 volts is applied by a DC power source 108 to all of the electrodes of both sets of electrodes 92 and 94. The AC voltage applied between the set of interdigitated electrodes establishes AC fringe fields serving to liberate toner particles from the surface of the donor structure 42 to form the toner cloud 112 in the development zone 300. The AC voltage is referenced to the DC bias applied to the electrodes so that the time average of the AC bias is equal to the DC bias applied. Thus, the equal DC bias on adjacent electrodes precludes the creation of DC electrostatic fields between adjacent electrodes which would impede toner liberation by the AC fields the development zone 300.

When the AC fringe field is applied to a toner layer via an electrode structure in close proximity to the toner layer, the time-dependent electrostatic force acting on the charged toner momentarily breaks the adhesive bond to cause toner detachment and the formation of a powder cloud or aerosol layer 112. The DC electric field from the electrostatic image controls the deposition of toner on the image receiver.

The two sets of electrodes 92 and 94 are supported on a dielectric cylinder 93 and oriented in the axial direction near the surface in a circular orientation. A thin charge relaxable coating 70 is applied over the electrodes to prevent air breakdown between the AC biased interdigitated electrodes. Each of the electrodes 94 are electrically isolated on the donor roll whereas all of the electrodes 92 are connected. The AC voltage 104 applied to the active electrodes 94 is commutated via a conductive brush 107 contacting only those electrically isolated electrodes 94 positioned in the nip between the photoconductive surface and the donor roll. If the toned donor is subjected to the AC fringe field before the development nip, the development efficiency would be degraded. This observation implies that an AC field must be applied only in the development nip. Limiting the AC field region to a fraction of the nip width will also help to reduce toner emissions that are usually associated with other non-magnetic development systems.

The donor roll is spaced from the transfer roll and either a DC voltage 106 or a DC voltage plus an AC voltage 102, (for example, 1000 volts peak at 2 kHz), is applied to the transport roll to electrostatically transfer the desired polarity to the donor roll. The use of an AC voltage 102 aids the electrostatic transfer of toner from the transport to the donor roll. The transport roll is continuously loaded with ion charged toner from a fluidized bed of toner in which a high voltage applied to a set of wires 215 is positioned near the transport roll. The gaseous ions generated by the wires collect on the toner. The charged toner is attracted to the transport roll by electrostatic forces. An air injection system fluidizes the toner in the chamber. The injection system and the donor member cooperate with one another to define a region wherein a substantially constant quantity of toner having a substantially constant ion charge is deposited on the transport member. The amount of toner deposited on the transport roll can be controlled by the DC voltage 84 applied to the charging unit 215.

As illustrated in FIG. 3, an alternating electrical bias is applied to the active interdigitated electrodes 92 and 94 by an AC voltage source 104. The applied AC establishes an alternating electrostatic field between the interdigitated electrodes 92 and 94 which is effective in detaching toner from the surface of the donor roller and forming a toner cloud 112, the height of the cloud being such as not to be substantially in contact with the belt 10, moving in direction 16, with image area 14. The magnitude of the AC voltage is on the order of 800 to 1,200 volts peak at a frequency ranging from about 1 kHz to about 6 kHz. A DC bias supply 108, which applies approximately –300 volts to donor roll 42 establishes an electrostatic field between photoconductive surface 12 of belt 10 and donor roll 42, for attracting the detached toner particles from the cloud to the latent image recorded on the photoconductive surface. An AC voltage of 800 to 1,200 volts produces a relatively large electrostatic field in the development zone 300 without risk of air breakdown.

As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser. In this manner, a substantially constant amount of toner particles are in the chamber of the developer housing with the toner particles.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface, comprising:

a housing defining a chamber storing a supply of developer material comprising single component toner;

means for fluidizing said developer material in the chamber of said housing;

a charging device emersed in said fluidized toner for ion charging said developer material;

a transport member, partially emersed in said fluidized toner, said transport member being biased to attract developer material on an outer surface of said transport member;

a toner donor member, adjacent to said transport member and spaced from the imaging surface, for transporting toner from transport member to a region opposed from the imaging surface, said toner donor member having electrode members positioned near an outer surface thereof, said electrodes being electrically biased to detach toner from said donor member as to form a toner cloud for developing the latent image.

2. An electrophotographic printing machine, wherein an electrostatic latent image recorded on a photoconductive member imaging surface is developed to form a visible image thereof, comprising:

a housing defining a chamber storing a supply of developer material comprising single component toner;

means for fluidizing said developer material in the chamber of said housing;

a charging device emersed in said fluidized toner for ion charging said developer material;

a transport member, partially emersed in said fluidized toner, said transport member being biased to attract developer material on an outer surface of said transport member;

a toner donor member, adjacent to said transport member and spaced from the imaging surface, for transporting toner from transport member to a region opposed from the imaging surface, said toner donor member having electrode members positioned near an outer surface thereof, said electrodes being electrically biased to detach toner from said donor member as to form a toner cloud for developing the latent image.

3. A color electrophotographic printing machine, wherein an electrostatic latent image is recorded on a photoconductive member imaging surface and is developed with toner of a first color and is subsequently recorded with a second latent image and developed superimposed on the first latent image with toner of a second color onto the photoconductive member prior to transferring of the composite toner powder image onto the substrate, comprising:

a housing defining a chamber storing a supply of developer material comprising single component toner;

means for fluidizing said developer material in the chamber of said housing;

a charging device emersed in said fluidized toner for ion charging said developer material;

a transport member, partially emersed in said fluidized toner, said transport member being biased to attract developer material on an outer surface of said transport member;

a toner donor member, adjacent to said transport member and spaced from the imaging surface, for transporting toner from transport member to a region opposed from the imaging surface, said toner donor member having electrode members positioned near an outer surface thereof, said electrodes being electrically biased to detach toner from said donor member as to form a toner cloud for developing the latent image.

* * * * *